US007654216B2

(12) United States Patent
Grieger

(10) Patent No.: US 7,654,216 B2
(45) Date of Patent: Feb. 2, 2010

(54) BOAT ROOF, AND BOAT HAVING SAME

(75) Inventor: Andreas Grieger, Kressbronn (DE)

(73) Assignee: Aguti Produktentwicklung & Design GmbH, Langenargen (DE)

( * ) Notice: Subject to any disclaimer, the term of this patent is extended or adjusted under 35 U.S.C. 154(b) by 0 days.

(21) Appl. No.: 11/876,939

(22) Filed: Oct. 23, 2007

(65) Prior Publication Data

US 2008/0098947 A1 May 1, 2008

(30) Foreign Application Priority Data

Oct. 27, 2006 (DE) ..... 10 2006 051 378

(51) Int. Cl.
*B63B 17/02* (2006.01)

(52) U.S. Cl. ..... 114/361; 114/343

(58) Field of Classification Search ..... 114/343, 114/361, 364; 135/117, 119; 296/107.17
See application file for complete search history.

(56) References Cited

U.S. PATENT DOCUMENTS

| | | | | |
|---|---|---|---|---|
| 2,280,729 | A * | 4/1942 | Sutton | 114/361 |
| 3,035,281 | A * | 5/1962 | Pearson | 114/361 |
| 4,223,414 | A * | 9/1980 | Dickson | 114/361 |
| 5,044,298 | A * | 9/1991 | Pepper et al. | 114/361 |
| 5,339,759 | A | 8/1994 | Peabody | |
| 5,361,717 | A | 11/1994 | Kobayashi | |
| 6,701,863 | B2 * | 3/2004 | Kalhok et al. | 114/361 |
| 6,837,173 | B2 * | 1/2005 | Eck et al. | 114/361 |
| 6,860,222 | B2 * | 3/2005 | Himmel | 114/361 |
| 7,013,830 | B1 | 3/2006 | Willis | |
| 7,093,558 | B1 | 8/2006 | Mandanici | |
| 2003/0127036 | A1 | 7/2003 | Pastor et al. | |
| 2003/0127037 | A1 | 7/2003 | Himmel | |
| 2003/0217683 | A1 | 11/2003 | Heckman | |
| 2006/0162640 | A1 | 7/2006 | Tufte | |
| 2006/0231010 | A1 * | 10/2006 | Baylor | 114/361 |

FOREIGN PATENT DOCUMENTS

| | | |
|---|---|---|
| DE | 198 23 377 C1 | 1/2000 |
| DE | 199 51 619 A1 | 4/2001 |
| DE | 20 2006 009 963 U1 | 9/2006 |

* cited by examiner

*Primary Examiner*—Lars A Olson
(74) *Attorney, Agent, or Firm*—Burr & Brown

(57) ABSTRACT

A boat roof on a boat deck is provided, including a roof element. The roof element can be raised via a pivoting mechanism with a lifting unit, by pivoting about a pivoting axis in order to produce an opening gap between the roof element and the remaining deck area. A boat having such a boat roof is also provided.

16 Claims, 1 Drawing Sheet

BOAT ROOF, AND BOAT HAVING SAME

This application claims the benefit under 35 USC §119(a)-(d) of German Application No. 10 2006 051 378.9, filed Oct. 27, 2006, the entirety of which is incorporated herein by reference.

FIELD OF THE INVENTION

The present invention relates to a boat roof, in particular yacht roof, on a boat deck, the boat roof comprising a roof element, and to a boat having such a boat roof.

BACKGROUND OF THE INVENTION

Displaceable roofs are used on the decks of watercrafts or boats, such as, motor-powered or sailing yachts. For example, a roof element of a boat roof can be moved from the roof position into a storage position by means of a lever fitted movably thereon. Structures of this type, however, are comparatively awkward to set up and may constitute a risk of injury to individuals, and require valuable space on the boat deck when in the storage position.

SUMMARY OF THE INVENTION

It is the object of the present invention to provide a boat and a boat roof which can be compactly accommodated and moved simply and safely, and wherein the protective function of the boat roof is largely retained.

The present invention is based first of all on a boat roof, in particular yacht roof, on a boat deck, and the boat roof comprises a roof element. An essential aspect of the invention is that a pivoting mechanism with a lifting unit is provided, by means of which pivoting mechanism the roof element can be raised by pivoting about a pivoting spindle in order to produce, for deck areas remaining as a result, an opening gap between the roof element and the remaining deck areas. A boat roof can thereby be displaced particularly simply and rapidly. The roof element can be brought into a placed or raised position in relation to the deck area, which is adjacent to the roof element and is not moved, such as a wall section downwardly adjoining the roof element, or can be brought out of this position again into a position covering the remaining deck areas. The roof element can also be advantageously used if the roof element permits, only a relatively small degree of pivotability. The degree of pivotability about an axis can be designed to be pivotable, about a few angular degrees or else to more than 45 angular degrees. It is particularly advantageous in this case for the roof element to retain a virtually unchanged protective function for areas located beneath it, even in one of the many positions in which it is raised to differing extents. For example, a high level of protection against rain or sun can therefore be realized even when the roof element is raised.

The pivoting mechanism and the roof element are preferably designed to raise the roof element as a whole. The raising of the entire roof, which can comprise one component, is comparatively uncomplicated to realize.

It is advantageous for the roof element to have an essentially invariable contour, in particular an essentially rigid shape. The roof element can be raised with the shape remaining essentially the same. With this procedure, the roof element can be completely pivoted and raised and lowered. The essentially rigid boat roof can be constructed from plastic or wood or a combination of materials, for example. The pivoting of the roof element can therefore take place without changing its shape. The boat roof can therefore be configured as a statically supporting part or with an appropriate load-bearing capacity and such that it is stable.

A lightweight construction, a reduction in size of the roof, collapsing or folding is not necessary for the lifting or lowering of the roof. In principle, virtually any type of roof element, for example a rigid or partially flexible roof, can be moved and no additional devices have to be provided to reduce the size of the roof or fold it up. However, it is basically not ruled out that the boat roof itself has a size-reducing possibility or can be displaced into itself or, for example, is designed flexibly at least over subsections. In particular, the roof element will have at least one essentially stiff edge contour, with it being possible for adjoining or further inward roof element sections to be designed to be open or constructed with non-stiff materials, for example, with a partially flexible or textile-like material.

Furthermore, the pivoting mechanism is preferably configured to make an opening gap possible at the bow end. The opening gap can thus be provided at least in the direction of travel of the boat, which, in particular brings about highly effective ventilation, even if the opening gap is relatively narrow, when the boat is in motion.

The roof element is advantageously designed as part of the construction of the boat deck. The pivotable roof element is expedient and advantageous in particular if there are superstructures on the deck, since areas on deck are generally to be protected against external influences, such as, for example, wind, weather, water and sunlight. With the boat roof proposed, the areas or the interior thereof can, if desired, be fully or at least mostly shielded or closed by the roof element, or the inner area can be in contact with the external surroundings to differing extents via the particular size of the opening gap.

The roof element is preferably designed for arranging over an area occupied by individuals, such as, for example, a control stand. The roof element can therefore be pivoted, closed or opened to differing extents depending on the individual requirements of the individual concerned or in accordance with the prevailing external conditions. Conceivable superstructures on the deck over which the roof element can be arranged include, for example, a control stand, a cockpit, a deck lounge or another area occupied by individuals. In principle, the roof element can also be used over deck areas or compartments which are not used or are used only briefly by individuals, such as equipment, storage and engine compartments.

It is particularly preferred that the roof element is designed for arranging over a transparent cockpit-like area. The boat roof or the roof element can thus be advantageously used even in an area which makes it possible for individuals to have a relatively good view to the outside or lets in light from the outside in a control stand. The transparent cockpit area or deck construction can be understood as meaning, for example, a continuously transparent wall section or else a side area or a wall area which is transparent at least in some sections. The side area or wall area can also have, for example, transparent inserts, for example, windows or the like. The boat roof or roof element may correspondingly also be transparent, at least partially transparent or light-permeable, but it is not necessarily transparent. The individual concerned generally also has to spend comparatively lengthy amounts of time in such, in particular, viewing areas or observation areas with transparent walls or walls with glazed wall sections in order to steer the boat. It is therefore particularly advantageous that the interior climate can be influenced. According to the present invention, the protective function of the roof element is advantageously and largely retained even when the roof element is pivoted. The individual's time spent there can therefore be designed to be particularly pleasant. In particular, ventilation, which is perceived to be refreshing, or a desired temperature in the area covered by the boat roof can be influenced without the individual who is under the raised roof element being exposed to the direct rays of the sun, or while the individual otherwise remains protected within a shady area provided by the roof element.

In an advantageous refinement of the subject matter of the invention, the pivoting mechanism has a pivoting spindle on a stern-end area of the roof element. The roof element can therefore be pivoted, in particular about a spindle fitted, with respect to the direction of travel of the watercraft, to the rear end of the roof element. With this arrangement, an opening gap between the roof element and the remaining deck section can be realized particularly rapidly and without relatively great pivoting distances. In particular, the opening gap can be set up below the boat roof in the direction of travel such that, when the boat is in motion, particularly effective ventilation or influencing of the temperature on the deck below the roof element can be realized. However, protection against the sun, wind or rain is retained by the raised roof element. In particular, irrespective of the protective function of the roof element, the type or strength of the ventilation or the adaptation of temperature can be determined and set by the particular raised position of the roof element.

In principle, the pivoting spindle or a corresponding hinge arrangement can be formed, not only in the stern-end or rear end area of the roof element, but also at a different location, such as in the central area between the bow and the stern ends of the roof element.

In addition, it is advantageous that, because of the pivoting axis of the stern-end area of the roof element, a front area of the roof element does not have to be changed, which is particularly advantageous in the case of control stands or rooms with an outlook. The front or side area of the roof element can therefore remain free from possibly disturbing pivoting-spindle devices.

A preferred refinement of the subject matter of the invention is distinguished in that two struts are provided on the roof element, which struts extend in the direction of the boat stern and on which the pivoting spindle is formed. The roof element can therefore be set up particularly elegantly and compactly in a manner such that it is able to pivot. In this case, the pivoting spindle can be positioned in accordance with the length of the struts away from the actual roof element area which is to be covered. If struts are configured in the manner of extension arms and extend to the rear beginning from a main part of the boat roof on, two opposite sides of the actual roof element are used, the pivoting spindle can be provided at the end of the struts. For example, at least two separate pivoting spindle sections can thus be realized. In this manner, and also via a corresponding mounting which can be set up on each strut, advantageous support of the movable roof element can be achieved. In principle, the pivoting spindle can also be formed by a single spindle, for example passing through both struts, thus enabling a particularly stable pivoting spindle arrangement which can be produced in a simple manner to be realized. In a simple case, this can be realized, for example, by means of a rod-like element.

Furthermore, it is proposed that the lifting unit has a hydraulic unit which can be actuated by motor. A hydraulic unit which operates by motor enables even comparatively heavy loads or roof element structures to be easily raised and lowered. The roof element, possibly also with a load mounted on it, for example, temporarily, can be moved by a correspondingly designed hydraulic unit. The roof element can therefore also be used, if appropriate as a storage surface for objects. In the case of hydraulic systems, it is furthermore advantageous that, when the roof element is raised, the lowering can take place safely and uniformly and gently, if appropriate without a drive or just under the action of the roof load. In addition, a sensitive or infinitely variable displacement of the roof position can be achieved by means of the hydraulic unit. In addition, it is particularly advantageous that generally, in the case of boats from a corresponding size or in the case of motor-powered yachts, hydraulic supply units which are already present can be used or preconditions are present in order to set up, with comparatively little additional outlay, a hydraulic device which can be actuated by motor and is intended for moving the roof element.

However, it is also conceivable to realize the lifting unit in a different manner, for example, with an electric motor.

The lifting unit preferably acts on a lateral edge area of the roof element. The overall optical impression of the roof is therefore only adversely affected to a comparatively slight extent. In addition, the roof element can be loaded in a balanced manner as it is being raised and lowered or the effective forces or moments can act on two or more points on the roof element, as a result of which, in particular, damage to the roof element or to adjacent devices can be avoided.

It is further proposed that the lifting unit acts in the area of the pivoting spindle. In particular, the lifting unit can function via a lever arrangement acting on the roof element or the pivoting spindle of the roof element. The main unit of the lifting unit, for example, a hydraulic cylinder with a piston which is movable therein and with a supply device, does not have to be positioned directly or close to the roof element, but rather can be accommodated separately from the roof element, for example, below the boat deck or in an engine compartment area. The lifting unit can be accommodated in a concealed or visually unobtrusive manner because it acts on the pivoting spindle which is generally located in the rear roof area.

It may also be advantageous, for example, for static, structural or spatial reasons, if the lifting unit acts below on a lateral edge area or on an essentially stiff edge contour of the roof element. The roof contour can be essentially stiff or rigid, for example, over its entire extent or over subsections. A corresponding engagement point of the lifting unit can advantageously be provided, in particular on two opposite or on both longitudinal sides of the lateral edge sections of the roof element. As a result, the roof element can be pivoted particularly uniformly, or also different roof inclinations or spatial representations of the roof element can be realized, if appropriate, also with a corresponding roof element mounting which permits, for example, a compensating movement. If desired, opening gaps, for example of differing size, can thus be obtained on the particular side of the roof element between roof lower edge and upper edge of the remaining deck area.

Furthermore, it is preferred that the lifting unit comprises two displacement elements which are positioned, for example, on opposite sections with respect to a longitudinal axis of the roof element. This enables the roof element to be lifted and lowered uniformly and in a balanced manner. With two displacement elements, the force to be applied in each case per lifting unit is advantageously correspondingly less than or half the size than in the case of just one displacement element. In principle, more than two displacement elements can also be used. The displacement element can comprise, in particular, a lifting rod of a piston which can be moved in a hydraulic cylinder, with, for example, the front end of the lifting rod acting directly or indirectly on the roof element.

In addition, the invention relates to a boat, in particular a motor-powered yacht, with a boat roof designed in one of the abovementioned ways.

The boat preferably has a transparent cockpit-like area on which the pivotable roof element can rest. By means of the cockpit area, the free view or protection is advantageously retained, for individuals in a control stand. The transparent area can form the entire wall or at least an upper part of the remaining deck area and can extend upward, for example, to above the headroom of an individual standing thereon. Raising of the boat roof enables an element of fresh air to be let in, with the roof element continuing to provide virtually complete protection against the sun, in particular when the sun is high in the sky.

The transparent cockpit-like area is preferably configured in such a manner that, when the roof element is lowered, the cockpit-like area is closed at the bow end and is open at the stern end. It is therefore possible to set up a boat deck area which is perceived to be particularly pleasant and is, for example, open or closed laterally and is open to the rear, either with or without a roof covering. The front part of the deck area under consideration lies under the protective part of the roof element and can be protected, for example, against relative wind and sun to the front and upward. By even slight raising of the boat roof, the opening gap which is formed can result in very effective ventilation or adaptation of the temperature, since the rear part of the area is open and permits a draft. The transparent cockpit-like section or wall section can be formed over the entire area covered by the roof element or over just part.

The cockpit-like area or the wall section can comprise an upper edge which, in particular is of continuous design and on which the lowered roof element can rest. When the roof element is lowered or closed, it can therefore be positioned directly on the upper edge of the cockpit-like area in such a manner that tight closing is realized, in particular if, for example, seals, for example rubber-like or flexible edge coverings, are provided on the corresponding sections which bear against each other. In particular, the raiseable and lowerable roof element does not affect the wall section itself in any way. When the roof is lowered, in particular a tight closed position of the roof element on the cockpit-like area or, if appropriate complete shielding to the outside of the compartment spanned by the roof element can therefore be set up.

For better support or for static or safety reasons, for example, a supporting element, which is coupled to the movement of the roof element and is intended for supporting the roof element, can be designed such that it acts on said roof element. In the case of particularly heavy roof elements or in the case of comparatively stringent mechanical requirements for raising and lowering the roof element, it may be advantageous to provide a corresponding supporting element for supporting or absorbing the weight of the roof element. This can be, for example, a rod which increases or shortens in length, for example, a telescopic rod with a fixing mechanism, or a pivoting lever and the like.

BRIEF DESCRIPTION OF THE DRAWINGS

In the two figures, two exemplary embodiments of a boat roof according to the invention or of a motor-powered yacht are illustrated in a highly schematized manner.

DETAILED DESCRIPTION OF THE INVENTION

Figure 1:
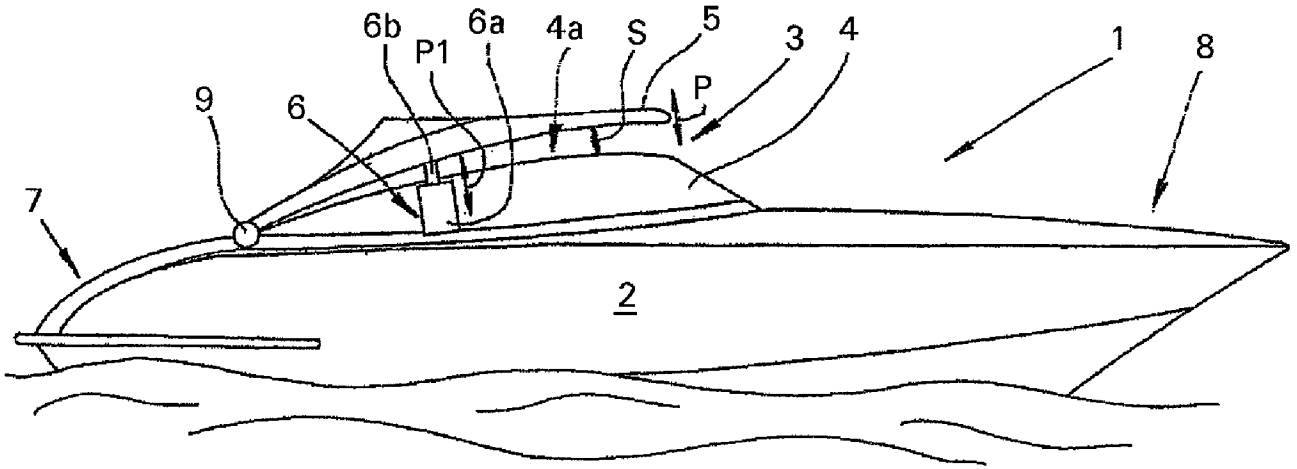
FIG. 1 shows a motor-powered yacht in the water from the side with a boat roof according to the invention which is in a partially raised position.
Figure 2:
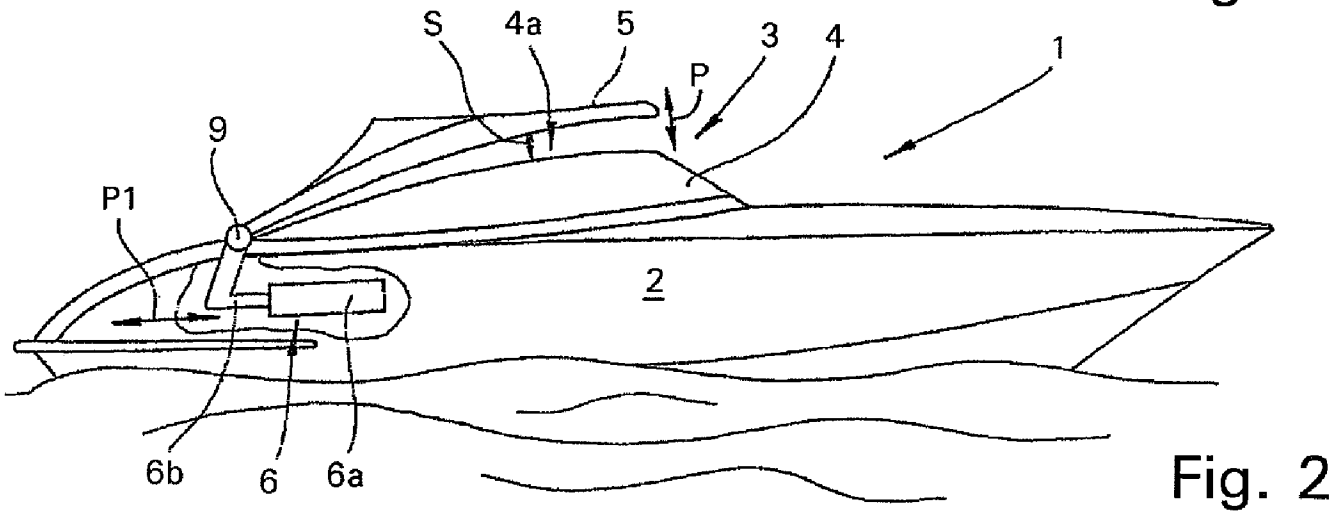
FIG. 2 shows a motor-powered yacht in the water from the side and partially cutaway, with an alternative boat roof which is likewise partially raised.

In FIGS. 1 and 2, the same reference numbers are used for corresponding components.

The figures illustrate schematically a motor-powered yacht 1 in a stretch of water. The motor-powered yacht 1 comprises, inter alia, a hull 2 and a control stand 3 on the deck of the motor-powered yacht 1. Further parts and details of the motor-powered yacht 1 are not shown or are merely indicated. The control stand 3 comprises a wall section 4 which is U-shaped, as viewed from above and in particular, is transparent and can be composed, for example, of glass or plastic.

For example, a shell-shaped roof element 5 of the control stand 3 can be raised and lowered in accordance with the arrow P and, in the lowered state, can close off the control stand to the outside, in particular tightly. In principle, it is also conceivable that, even when the roof element is lowered, a comparatively low level of ventilation of the control stand is retained. A lower side of the roof element 5 is matched to an upper edge 4*a* of the wall section 4 in such a manner that the upper edge 4*a* and those sections of the roof element lower side which can be brought into contact therewith press tightly against one another when the roof element 5 is lowered and, when it is slightly raised, an opening gap is formed in a defined manner between them. For this purpose, the edge 4*a* and the lower side of the roof element 5 can be configured with a contour which is slightly curved and is in each case coordinated.

In particular, the corresponding sections are configured in such a manner that, in the lowered state (not illustrated) of the roof element 5, the control stand 3 can be tightly closed off at least to the front and/or laterally or completely to the outside. If appropriate, further devices such as, for example, a locking mechanism (not illustrated) may be provided for the firm pressing-on of the roof element 5 or for a closed state of the roof element 5 that cannot be released from the outside.

A lifting unit 6 is provided in each case to lift and lower the roof element 5 by pivoting. Said lifting unit is designed, in particular and for example, as a hydraulic unit with a hydraulic cylinder 6*a* and a piston which can be moved in the hydraulic cylinder 6*a* and has a piston rod 6*b*. The piston rod 6*b* can be retracted and extended in relation to the hydraulic cylinder 6*a* via a supply device (not illustrated) or additional hydraulic devices and, in particular, controlled by motor or via a suitable control unit. In FIG. 1, the piston rod 6*b* is illustrated partially extended, as a result of which the roof element 5 is in a position which is partially raised with respect to the edge 4*a* of the wall section 4. An opening gap S can be set here between the lower side of the roof element 5 and the upper edge 4*a* of the wall section 4. At a fixed opening position of the roof element 5, the opening gap S may differ in size over its extent along the upper edge 4*a*, for example, in a rear area of the roof element 5 in the direction of the stern 7 of the ship, the opening gap S may be smaller than in a front area closer to the bow 8 of the ship. In the exemplary embodiments according to FIGS. 1 and 2, the opening gap S decreases in size uniformly from the front of the roof element 5 until it disappears close to the rear or stern end of the roof element with a pivoting spindle 9.

The pivoting spindle 9 is designed for pivoting the roof element 5 and is indicated only in a highly schematic form. In FIG. 1, there are, in particular, two lifting units 6, for example, identical hydraulic devices, acting on opposite sides of the roof element 5, of which a second lifting unit, which is concealed in FIG. 1, is positioned in relation to the lifting unit 6.

FIG. 2 illustrates an alternative arrangement of the lifting unit 6, which arrangement shows a hydraulic cylinder 6*a* accommodated in the hull 2 and a piston rod 6*b*, which are visible because areas of the hull wall are omitted. In contrast to the arrangement according to FIG. 1, the hydraulic cylinder 6*a* with the piston rod 6*b* is oriented approximately horizontally. The lifting unit 6 acts directly on or in the immediate vicinity of the pivoting spindle 9. For this purpose, the piston rod 6*b* is correspondingly configured, for example, angled with a front angled subsection acting on the pivoting spindle 9. As a result, for example, the movement of the piston rod 6*b* according to FIG. 2, which is illustrated by the double arrow P2, is coupled to the lifting and lowering of the roof element 5*a*. Extension of the piston rod 6*b* out of the hydraulic cylinder 6*a* causes the roof element 5, according to FIG. 2 to be lowered and brought into a closed position (not illustrated). Retraction of the piston rod 6*b* into the hydraulic cylinder 6*a* causes the roof element 5 to be brought into an open position or raised position, for example, as illustrated in FIG. 2. The movement of the roof element 5 in the vicinity of its front end is indicated by the double arrow P and the movement of the piston rod 6*b* by the double arrow P1.

In principle, other movement drives for moving the roof element 5 are also conceivable, for example an electric motor.

LIST OF REFERENCE NUMBERS

1 Motor-powered yacht
2 Hull
3 Control stand
4 Wall section
4*a* Edge
5 Roof element
6 Lifting unit
6*a* Hydraulic cylinder
6*b* Piston rod
7 Boat stern
8 Boat bow
9 Pivoting spindle

I claim:

1. A boat roof provided on a boat deck, said boat roof comprising:

a pivotable roof element including a pivoting mechanism having a lifting unit, wherein the pivotable roof element covers areas of the boat deck capable of being occupied by individuals when the pivotable roof element is in both a lowered position, with no opening gap provided between portions of the pivotable roof element and portions of the boat deck, and a raised position, where an opening gap is provided between portions of the pivotable roof element and portions of the boat deck, whereby the pivoting mechanism raises the pivotable roof element by pivoting about a single pivoting axis in order to produce the opening gap between the roof element and portions of the boat deck.

2. The boat roof as claimed in claim 1, wherein the pivoting mechanism and the pivotable roof element raise the pivotable roof element as a whole.

3. The boat roof as claimed in claim 1, wherein the pivotable roof element has an essentially invariable contour defining a rigid shape.

4. The boat roof as claimed in claim 1, wherein the pivoting mechanism is configured so that the opening gap is provided at a bow end of the boat.

5. The boat roof as claimed in claim 1, wherein the pivotable roof element is part of a construction on the boat deck.

6. The boat roof as claimed in claim 1, wherein the pivotable roof element is adjustably arranged over a transparent cockpit area.

7. The boat roof as claimed in claim 1, wherein the pivoting axis of the pivoting mechanism is located at a stern-end area of the pivotable roof element.

8. The boat roof as claimed in claim 1, wherein two struts are provided on the roof element, which struts extend in the direction of the boat stern and on which the pivoting axis is located.

9. The boat roof as claimed in claim 1, wherein the lifting unit includes a motor actuated hydraulic unit.

10. The boat roof as claimed in claim 1, wherein the lifting unit acts on a lateral edge area of the pivotable roof element.

11. The boat roof as claimed in claim 1, wherein the lifting unit acts on the pivotable roof element in an area of the pivoting axis.

12. The boat roof as claimed in claim 1, wherein the lifting unit comprises two displacement elements which are positioned on opposite sections with respect to a longitudinal axis of the pivotable roof element.

13. A motor-powered yacht having a boat roof provided on a boat deck, said boat roof comprising:

a pivotable roof element including a pivoting mechanism having a lifting unit, wherein the pivotable roof element covers areas of the boat deck capable of being occupied by individuals when the pivotable roof element is in both a lowered position, with no opening gap provided between portions of the pivotable roof element and portions of the boat deck, and a raised position, where an opening gap is provided between portions of the pivotable roof element and portions of the boat decks whereby the pivoting mechanism raises the pivotable roof element by pivoting about a single pivoting axis in order to produce the opening gap between the roof element and portions of the boat deck.

14. The motor-powered yacht as claimed in claim 13, wherein a transparent cockpit area is provided on which the pivotable roof element can rest.

15. The motor-powered yacht as claimed in claim 14, wherein the transparent cockpit area is configured so that when the pivotable roof element is lowered, the cockpit area is closed at a bow end of the motor-powered yacht and is open at a stern end of the motor-powered yacht.

16. A motor-powered yacht having a boat roof provided on a boat deck, said boat roof comprising:

a pivotable roof element including a pivoting mechanism having a lifting unit, whereby the pivoting mechanism raises the pivotable roof element by pivoting about a single pivoting axis in order to produce an opening gap between the roof element and areas of the boat deck;

wherein a transparent cockpit area is provided on which the pivotable roof element can rest; and wherein the transparent cockpit area is configured so that when the pivotable roof element is lowered, the cockpit area is closed at a bow end of the motor-powered yacht and is open at a stern end of the motor-powered yacht.

* * * * *

UNITED STATES PATENT AND TRADEMARK OFFICE

CERTIFICATE OF CORRECTION

PATENT NO. : 7,654,216 B2
APPLICATION NO. : 11/876939
DATED : February 2, 2010
INVENTOR(S) : Andreas Grieger It is certified that error appears in the above-identified patent and that said Letters Patent is hereby corrected as shown below:

Column 8

*Line 37*: change "decks" to --deck,--

Signed and Sealed this

Fifteenth Day of June, 2010

David J. Kappos

David J. Kappos
*Director of the United States Patent and Trademark Office*